US006458023B1

(12) United States Patent
Moon

(10) Patent No.: US 6,458,023 B1
(45) Date of Patent: Oct. 1, 2002

(54) MULTI CHARACTERIZED CHEMICAL MECHANICAL POLISHING PAD AND METHOD FOR FABRICATING THE SAME

(75) Inventor: Jin-Ok Moon, Seoul (KR)

(73) Assignee: Samsung Electronics Co., Ltd., Suwon-city (KR)

( * ) Notice: Subject to any disclaimer, the term of this patent is extended or adjusted under 35 U.S.C. 154(b) by 0 days.

(21) Appl. No.: 09/970,689

(22) Filed: Oct. 5, 2001

(30) Foreign Application Priority Data

Dec. 28, 2000 (KR) ..... 2000-83611

(51) Int. Cl.[7] ..... B24D 11/00

(52) U.S. Cl. ..... 451/526; 451/533; 451/534; 451/537; 51/295; 51/297

(58) Field of Search ..... 451/533, 534, 451/537, 539, 550; 51/295, 297, 298, 299

(56) References Cited

U.S. PATENT DOCUMENTS 5,664,989 A * 9/1997 Nakata et al. ..... 451/41
6,090,475 A * 7/2000 Robinson et al. ..... 428/212
6,132,292 A * 11/2000 Kubo ..... 451/36
6,174,227 B1 * 1/2001 Ishikawa ..... 451/533
6,354,925 B1 * 3/2002 Chou et al. ..... 451/259

* cited by examiner

*Primary Examiner*—Timothy V. Eley
*Assistant Examiner*—Alvin J Grant
(74) *Attorney, Agent, or Firm*—Volentine Francos, PLLC

(57) ABSTRACT

A multi characterized CMP (Chemical Mechanical Polishing) pad structure includes a lower pad and an upper pad. The lower pad includes a lower central soft pad region and a lower peripheral soft pad region formed outwardly of the lower central soft pad region, with both the lower central soft pad region and the lower peripheral soft pad region being located in a same plane of the lower pad. The upper pad is disposed on the lower pad, and includes an upper central hard pad region and an upper peripheral soft pad region formed outwardly of the upper central hard pad region, both the upper central hard pad region and the upper peripheral soft pad region being located in the same plane of the upper pad. The lower peripheral soft pad region has a lower hardness factor relative to the lower central soft pad region, and the upper peripheral soft pad region has substantially the same hardness factor as the lower central soft pad region.

17 Claims, 7 Drawing Sheets

MULTI CHARACTERIZED CHEMICAL MECHANICAL POLISHING PAD AND METHOD FOR FABRICATING THE SAME

BACKGROUND OF THE INVENTION

1. Field of the Invention

The present invention relates to equipment for fabricating a semiconductor device, and more particularly, to a non-homogeneous or multi characterized structure of a chemical mechanical polishing (CMP) pad for use in CMP equipment, and a method for fabricating the same.

2. Description of the Related Art

Semiconductor devices are comprised of numerous integrated circuits, which are produced by selectively and repeatedly performing a series of photographic, etching, diffusive, metal deposition, and other process steps. One particular process used on mass produced semiconductor wafers is an etch-back or polishing process to fully form device patterns that are pre-set on the wafer.

A chemical mechanical polishing (CMP) process is widely used in the semiconductor manufacturing field for horizontally planarizing various kinds of layers, such as oxide layers, nitride layers, metal layers and the like, which are sequentially deposited on the semiconductor wafer to form the integrated circuits. The CMP process is mostly used to polish metal or dielectric layers.

FIG. 1 is a typical CMP apparatus used to a polish a semiconductor wafer that has completed a deposition process. In FIG. 1, a polishing support, plate or table 2 is used for supporting and rotating a CMP pad 4 positioned on the table 2. A wafer 6 is fixed and rotated by a carrier 8, which moves vertically to selectively contact the CMP pad 4, which CMP pad 4 is also rotated at the same time by table 2. A slurry mixture, which comprises a mixture of predetermined types of chemicals and other ingredients, is provided at the central point of the CMP pad 4, and then evenly distributed and coated on the upper surface of the CMP pad 4 by the rotating force of the CMP pad 4. The semiconductor wafer 6 attached to the wafer carrier 8 selectively contacts the slurry covered CMP pad 4.

As a result of the relative rotation between the wafer 6 and the CMP pad 4 and the slurry mixture on the surface of the CMP pad 4, both mechanical friction and chemical reactions take place, and the material comprising the layer to be polished is gradually removed from the surface of the wafer. As a result, a wafer is said to be planarized to a certain pre-set thickness on the surface of the wafer. It is well known that the ultimate quality of the polished state of a thin wafer depends on several factors, including, among others: (i) the mechanical friction between CMP pad 4 and wafer 6, (ii) the material and state of the CMP pad 4, (iii) the composition and distribution rate of the chemical slurry, and (iv) the evenness or uniformity of the surface of the CMP pad 4.

With long-term utilization of the CMP equipment, the surface of the CMP pad 4 will gradually show irregularities in uniformity, making it difficult, if not impossible, to effectively polish the surface of the wafer 6 to the desired degree of planarization.

Therefore, in an effort to ensure the desired degree of evenness at the surface of the wafer 6 is maintained, a conditioner 9 is generally employed to uniformly grind the surface of the CMP pad 4 at a predetermined time interval. The conditioner 9 includes a grinding apparatus, such as artificial diamond structure, and the grinding apparatus first moves vertically to contact the surface of the CMP pad 4 and then rotates along the surface of the CMP pad 4 at a high speed. The conditioner 9 rotates and moves outwardly in a radial direction along the rotating CMP pad 4, thereby performing a conditioning process to remove a predetermined thickness of the material along the entire surface of the CMP pad 4.

The CMP pad 4 is made of polyurethane based compound, with a certain life cycle, so that it is impossible to use the CMP pad 4 for an unlimited amount of time by polishing with the conditioner 9. In other words, the CMP pad 4 must be replaced with a new CMP pad after a certain period of time elapses.

As further shown in FIG. 1, the CMP pad 4 includes a lower soft pad portion 20 contacting the table 2, and an upper hard pad portion 10 which contacts the wafer 6. More particularly, as shown in FIG. 2, the lower soft pad portion 20 is deposited on an attaching part 25, which reinforces the bonding force with table 2 of the CMP equipment. The upper hard pad portion 10 is placed on the lower soft pad portion 20, with another attaching layer 15 disposed therebetween. The attaching layer 15 functions to integrate the soft and hard pads 20 and 10. For example, the "IC 1000" and "Suba IV" polishing pads produced by the RODEL Co. may be used for the hard and soft pads 10 and 20, respectively. In another embodiment as shown in FIG. 3, the lower soft pad 30 has a lower degree of hardness relative to the hardness of the lower soft pad 20 of FIG. 2. The soft pad 30 may be a "Foam Pad" produced by the RODEL Co.

The CMP pads shown in FIGS. 2 and 3 have been generally constructed in the following manner. First, a mono-characterized or homogeneous chemical ingot is formed, say from a polyurethane based compound. The chemical ingot is then sliced into predetermined sized pads, and then bonded together.

If a polishing process is performed with the conventional CMP pads described above, CMP engineers face a problem in that there may be a difference in the polishing rates at the center and edge of a semiconductor wafer or chip. The difference in the polishing rates leads to a dishing or recess being formed, which produces an irregular surface on the polished semiconductor wafer. To alleviate the dishing phenomenon, most engineers focus on the non-uniformity of the slurry composition and the transfer rate of the slurry, or changes in the speed of the wafer, as the main causes of the problem to be corrected. They generally tend not to focus on improving the quality of a CMP pad itself.

FIG. 4 is a graph illustrating various removal rates of soft and hard pads at the center and edges of the wafer when a polishing process is performed with a conventional mono-characterized CMP pad. In FIG. 4, graphs 3*a*, 3*b* respectively indicate soft and hard pads. As shown FIG. 4, the difference in the etching rates of the hard pad at the center and edge of a wafer is more pronounced than that of the soft pad. The level of uniformity is even lower in a wafer having a large diameter of over 8 inches, as compared to a smaller diameter wafer, thereby negatively affecting the yield of products. For example, even if the amount of a interlayer dielectric 4 (ILD4) to be removed by the aforementioned CMP pad during the polishing step is very small, strong stresses may be generated and concentrated at the edge of the wafer to damage a semiconductor device pattern positioned at the edge of the wafer.

Therefore, there has been a strong demand for development of technology to improve polishing uniformity at the wafer level or chip level of a wafer, to thereby prevent or minimize dishing or recesses and any excessive damage caused to device patterns positioned at the edge of the wafer.

SUMMARY OF THE INVENTION

It is an object of the present invention to provide an improved structure of a CMP pad which can be adapted to presently utilized CMP equipment, and a method for fabricating the same.

It is another object of the present invention to provide a structure of a CMP pad to improve polishing uniformity of a wafer, and a method for fabricating the same.

It is another object of the present invention to provide a structure of a CMP pad to prevent or minimize dishing or recesses from being formed during a CMP process, and a method for fabricating the same.

It is another object of the present invention to provide a structure of a CMP pad to prevent excessive damage to device patterns at the edge of a wafer.

It is another object of the present invention to minimize failures during a CMP process and stabilize the CMP process to improve the yield of semiconductor device products.

To realize these and other objects, in a first aspect of the present invention, there is provided a multi characterized CMP (Chemical Mechanical Polishing) pad structure, which includes a lower pad and an upper pad. The lower pad includes a lower central soft pad region and a lower peripheral soft pad region formed outwardly of the lower central soft pad region, with both the lower central soft pad region and the lower peripheral soft pad region being located in the plane of the lower pad. The upper pad is disposed on the lower pad, and the upper pad includes an upper central hard pad region and an upper peripheral soft pad region formed outwardly of the upper central hard pad region, with both the upper central hard pad region and the upper peripheral soft pad region being located in the same plane of the upper pad. The lower peripheral soft pad region has a lower hardness factor relative to the lower central soft pad region, and the upper peripheral soft pad region has substantially the same hardness factor as the lower central soft pad region.

In another aspect, the present invention provides a lower pad having a lower homogeneous soft pad region, combined with the upper pad having an upper central hard pad region and an upper peripheral soft pad region formed outwardly of the upper central hard pad region. Both the upper central hard pad region and the upper peripheral soft pad region are located in the same plane of the upper pad. The upper peripheral soft pad region has substantially the same hardness factor as the lower homogeneous soft pad region.

In still another aspect, there is provided a method for fabricating a multi characterized CMP (Chemical Mechanical Polishing) pad, including preparing a first pad mixture having a first hardness, and injecting the first pad mixture into a first mold. The mixture is then cured to create a first cured ingot. A second pad mixture is prepared and injected into a second mold, peripherally formed around the first cured ingot. The second pad mixture is integrally cured to the first cured ingot to create a multi characterized ingot of a predetermined diameter. Preferably, the hardness factors for the first and second pad mixtures are different.

The multi characterized CMP pad structure and the method for fabricating the same in the present invention are advantageous in improving CMP process uniformity at the wafer level and chip level of highly integrated semiconductor devices, while at the same time stabilizing the process to increase product yields.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE INVENTION

Figure 1:
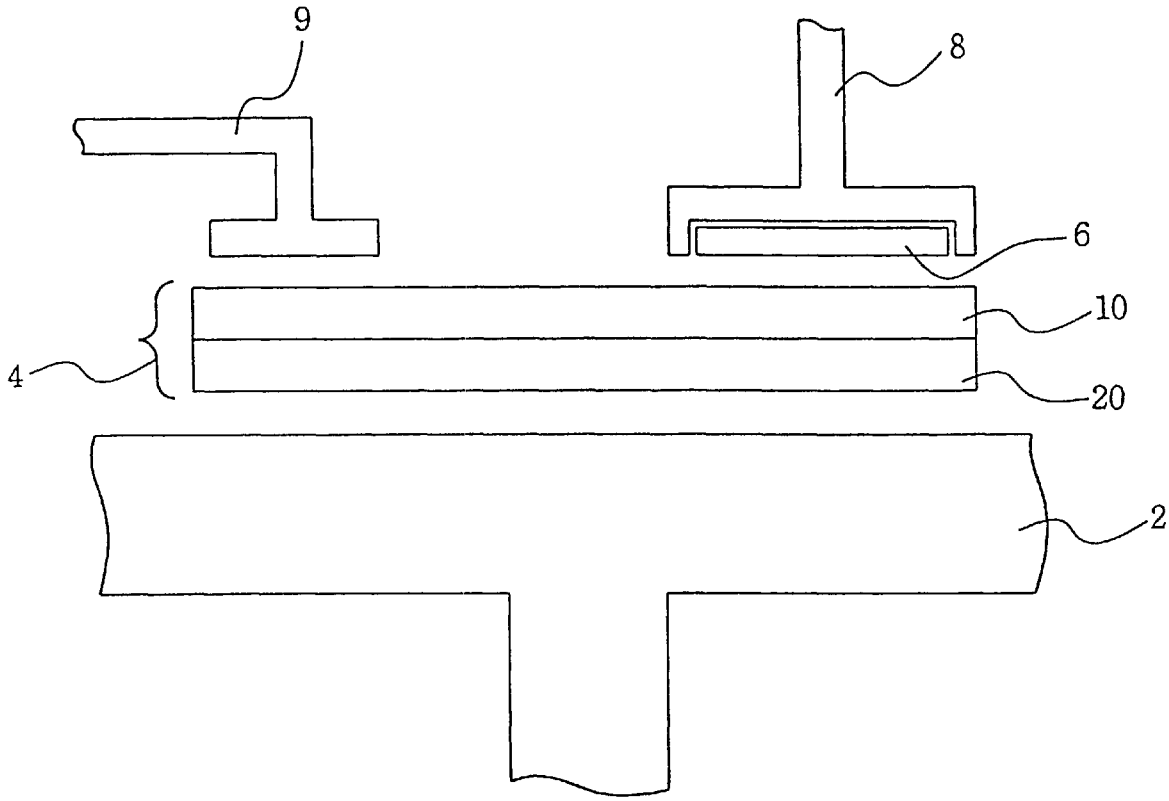
FIG.1 (PRIOR ART)
FIG. 1 is a schematic view illustrating the structure of general CMP equipment.
Figure 2:
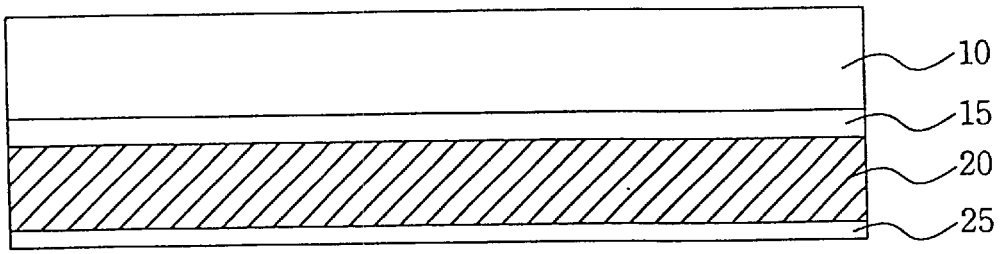
FIG.2 (PRIOR ART)
FIG. 2 and FIG. 3 are cross-sectional views illustrating structures of CMP pads in accordance with the conventional art.
Figure 3:
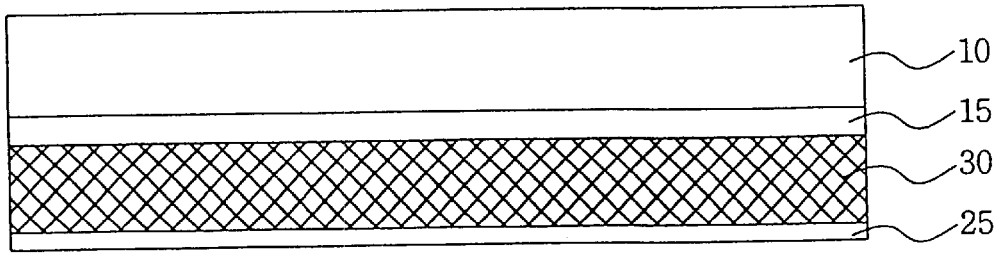
FIG.3 (PRIOR ART)
Figure 4:
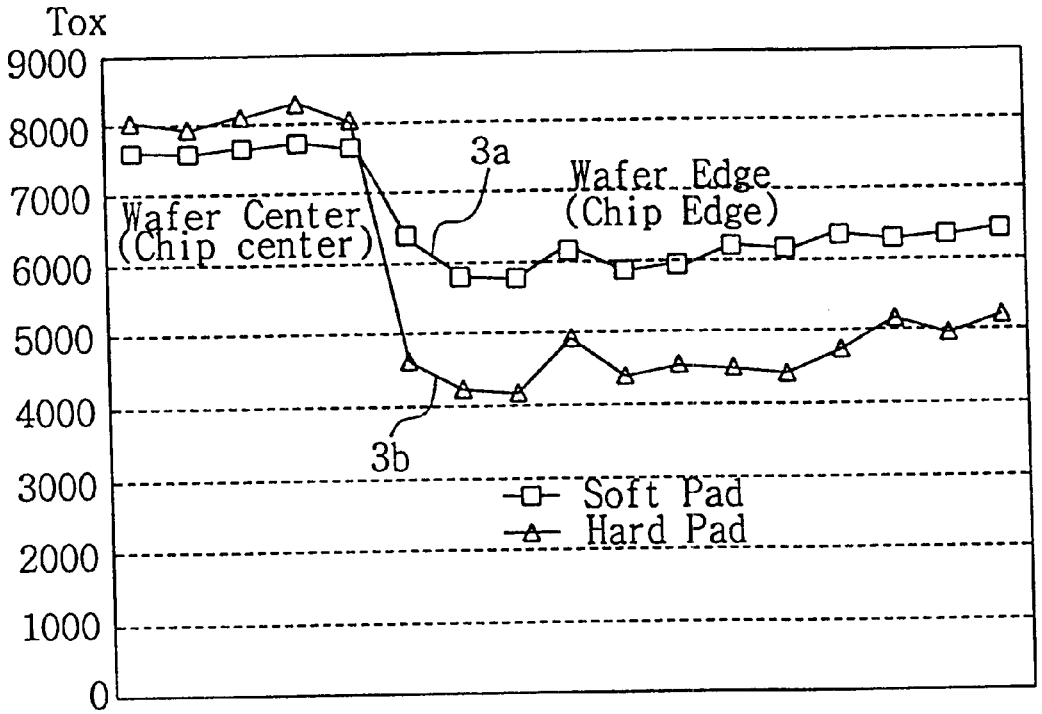
FIG.4 (PRIOR ART)
FIG. 4 is a graph illustrating the removal rates of hard and soft pads at the center and edge of a wafer.

The present invention will now be described more fully with reference to the accompanying drawings, in which a preferred embodiment of the invention is shown. This invention may, however, be embodied in many different forms and should not be construed as being limited to the embodiments set forth herein. Rather, the embodiments are provided so that this disclosure will be thorough and complete, and will fully convey the concept of the invention to those skilled in the art. In the drawings, the thickness of a layer or region are exaggerated for clarity. It will also be understood that when a layer is referred to as being "on" another layer or substrate, it can be directly on the other layer or substrate, or intervening layers may also be present.

Figure 5:
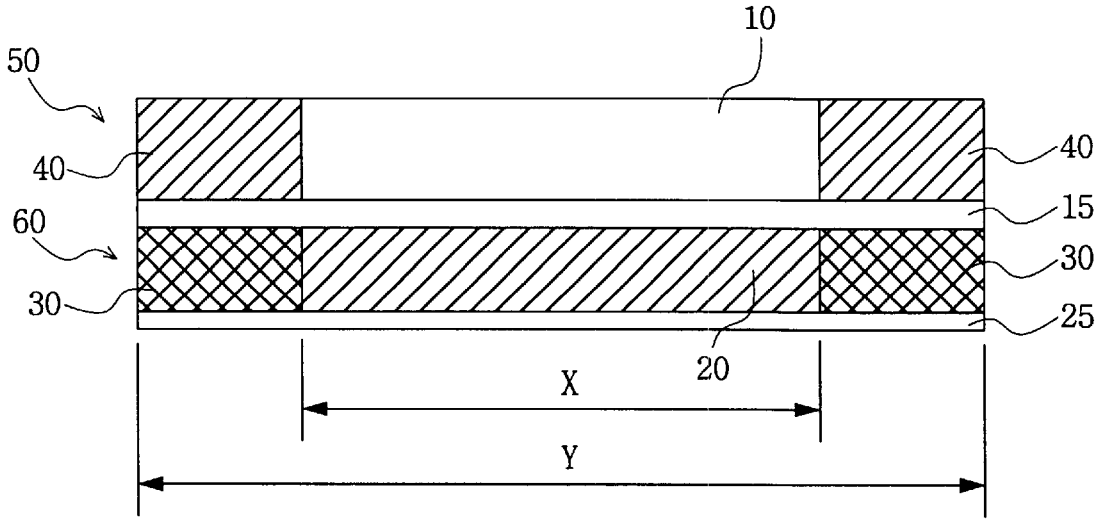
FIG. 5 is a cross-sectional view illustrating a multi characterized structure of a CMP pad in accordance with an embodiment of the present invention.

FIG. 5 is a cross-sectional view illustrating the structure of a CMP pad in accordance with an embodiment of the present invention. As shown in FIG. 5, a lower pad 60 is constructed or composed of two different soft pad regions, namely a lower central soft pad region 20 and a lower peripheral soft pad region 30, both of which are located in the same plane of the lower pad 60. The lower central soft pad region 20 has a first diameter 'x', and the lower peripheral soft pad region 30 is a ring shaped region formed radially outward of the lower central soft pad region 20. The lower peripheral soft pad region 30 has an inner diameter coexistent with the first diameter 'x', and an outer diameter 'y' larger than the first diameter 'x'. In other words, the lower peripheral soft pad region has an outer diameter greater then the first diameter, and an inner diameter equal to the first diameter. The lower peripheral soft pad region 30 is softer (i.e., has a lower degree of hardness), relative to the lower central soft pad region 20.

The upper pad 50 in FIG. 5 comprises an upper central hard pad region 10 and an upper peripheral soft pad region 40, both of which are located in the same plane of the upper pad 50. Upper central hard pad region 10 has a diameter "x", which is coextensive with the lower central soft pad region 20, although it need not be. In other words, the upper central hard pad region 10 can have a diameter greater than or less than diameter "x".

The upper peripheral soft pad region 40 is a ring shaped region formed radially outward of the upper central hard pad region 10, and is coextensive with the lower peripheral soft pad region 30 in this embodiment. Here again, the upper peripheral soft pad region 40 need not be coextensive with the lower peripheral soft pad region 30. In this embodiment, the upper peripheral soft pad region 40 has an inner diameter coexistent with the first diameter 'x', and an outer diameter 'y' larger than the first diameter 'x', and corresponding to the lower soft pad region 30. The upper peripheral soft pad region 40 is as soft (i.e., substantially the same degree of hardness) as the lower central soft pad region 20. For example, if the upper peripheral soft pad region 40 has a hardness comparable to the "Suba IV" polishing pad made by RODEL Co., the lower central soft pad region 20 would have a similar hardness, and the lower peripheral soft pad region 30 would correspond to that of the "Foam pad" made by RODEL Co. In this example, the upper central hard pad 10 may be made of the "IC 1000" polishing pad made by RODEL Co.

The lower pad 60 (comprising lower central soft pad region 20 and lower peripheral soft pad region 30) is secured to the bonding table 2 via attaching part 25. The attaching layer 15 functions to integrate the upper pad 50 and lower pad 60.

The CMP pad structure shown in FIG. 5 is designed to achieve reproducibility of CMP processes at the edge of a wafer. Accordingly, the peripheral portion of the lower pad is composed of a softer pad then the central portion of the lower pad. Also, the peripheral portion of the upper pad is composed of a softer material than the central portion of the upper pad. This CMP pad design structure ensures the head pressure exerted by the CMP equipment results in CMP pad uniformity during operation of the CMP equipment.

Figure 6:
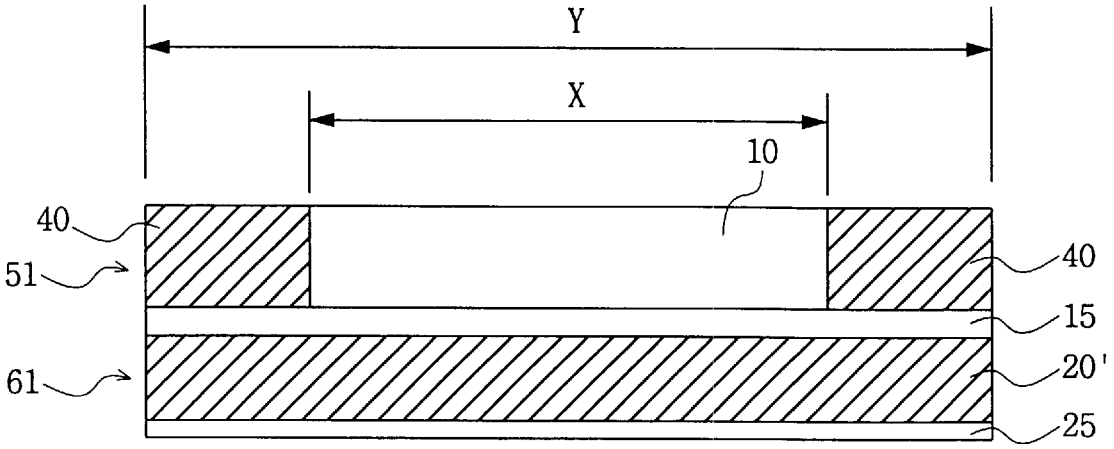
FIG. 6 is a cross-sectional view illustrating a multi characterized structure of a CMP pad in accordance with another embodiment of the present invention.

FIG. 6 is a cross-sectional view illustrating a multi characterized CMP pad structure in accordance with another embodiment of the present invention. FIG. 6 differs from FIG. 5 in that the lower pad 60 comprises a uniform or homogeneous lower soft pad region 20' having a diameter 'y'.

Similar to FIG. 5, the upper pad 50 in FIG. 6 comprises an upper central hard pad region 10 and an upper peripheral soft pad region 40, both of which are located in the same plane of the upper pad 50. Upper central hard pad region 10 has a diameter "x". The upper peripheral soft pad region 40 is a ring shaped region formed radially outward of the upper central hard pad region 10, and has inner diameter coexistent with the first diameter 'x', and an outer diameter 'y' larger than the first diameter 'x'. The upper peripheral soft pad region 40 is as soft (i.e., substantially the same hardness) as the lower central soft pad region 20. For example, if the upper peripheral soft pad region 40 has a hardness comparable to the "Suba IV" polishing pad made by RODEL Co., the lower central soft pad region 20 would have a similar hardness. In this example, the upper central hard pad 10 may be made of the "IC 1000" polishing pad made by RODEL Co.

The CMP pad structure shown in FIG. 6 is more suitable to minimize stress at the edge of a wafer because the lower pad is uniform and softer pads are applied to the peripheral portions of the pad then the central portions of the pad. As a result, some bending (elasticity) of the CMP pad occurs along the step coverage characteristics at the part contacting the wafer to reduce stress and optimally protect device patterns of the wafer.

Figure 7:
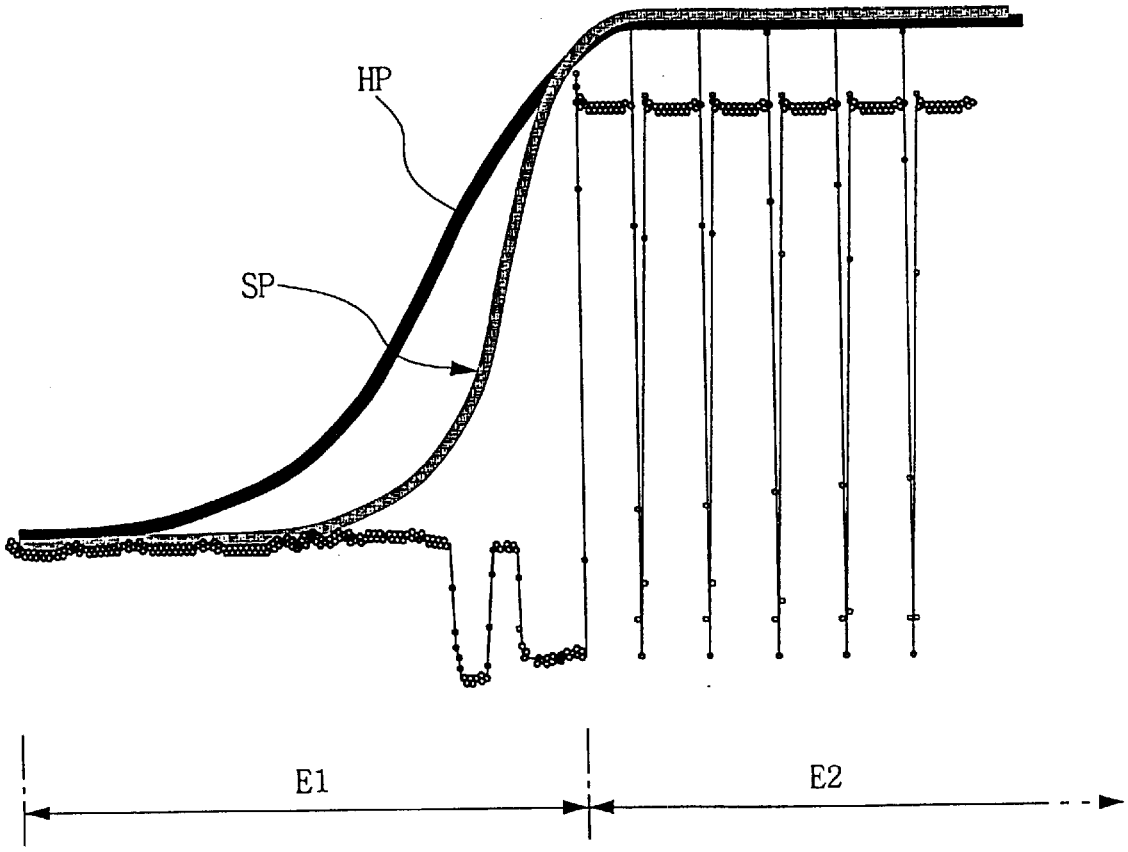
FIG. 7 is a graph illustrating the relationship of hard pads and soft pads relative to stress.

This feature is better illustrated with reference to FIG. 7, which is a graph showing the relationship of hard and soft pads versus stress. In FIG. 7, intervals E1 and E2 respectively indicate a device pattern portion with a small step coverage and another device pattern portion with a large step coverage. Also, reference symbols HP and SP respectively designate hard and soft pads. The data for FIG. 7 was generated while the CMP pad was rotated at about 150~200 rpm. From the data in FIG. 7, it can be seen that the soft pad SP has a superior bending characteristic (elasticity) relative to the hard pad HP, which means that that soft pad is more appropriate to minimize stress on the edge pattern.

Figure 8:
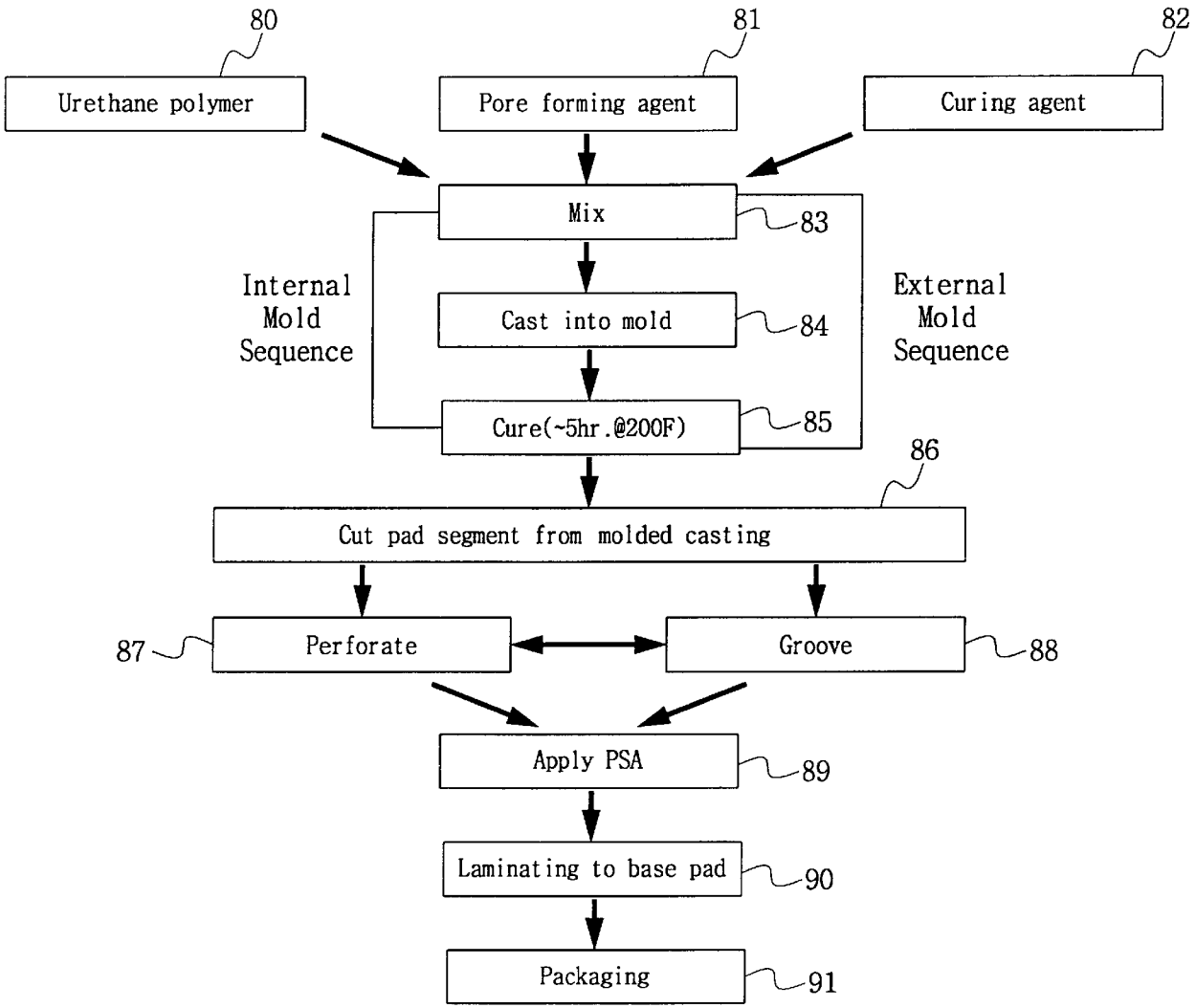
FIG. 8 is a flow diagram illustrating a sequence of steps to fabricate a CMP pad in accordance with an embodiment of the present invention.
Figure 9:
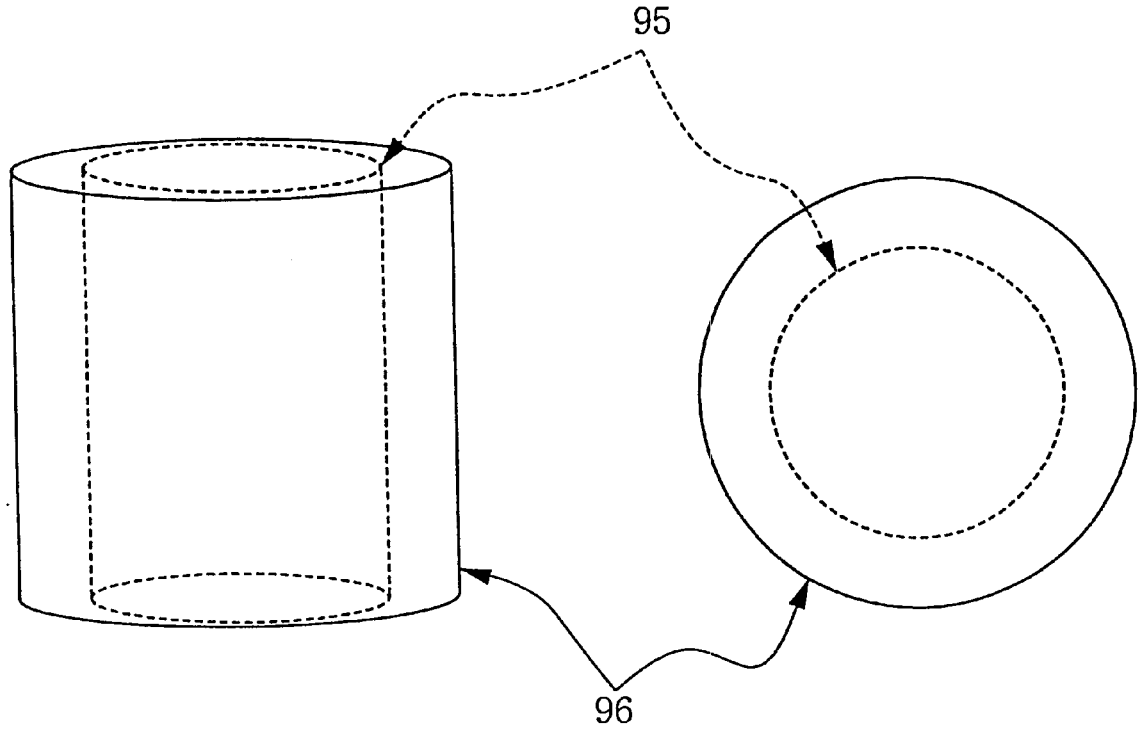
FIG. 9 is a schematic view illustrating a double mold used to fabricate the CMP pad described with reference to FIG. 8.

With reference to FIGS. 8 and 9, we will now discuss a method for fabricating a circular (or rotary) type CMP pad. An important element of the method for fabricating the CMP pad in the present invention is to form a multi-characterized pad within an identical layer by using a double mold. Accordingly, a detailed description of the slurry mixture or delivery rates thereof, as used in a typical polishing process, is not undertaken in the discussion of the method here, because they are well-known to the molding related field and easily applied to the present invention.

FIG. 8 is a flow diagram for illustrating a sequence of processes to fabricate a CMP pad in accordance with an embodiment of the present invention. FIG. 9 is a schematic view illustrating a double mold to make the CMP pad described in FIG. 8.

First, a urethane polymer, a pore forming agent and a curing agent prepared at steps 80, 81 and 82, respectively, are mixed by a mixer in step 83. The urethane polymer is a type of resin, comprising not just polyurethane, but at least one other material selected from chemical groups such as isocyanate-capped polyoxyethylene, polyester, vinyl-ester, acryl, ketone, polytetrafluorethylene, polyprophylene, polyethylene, polyamide, polyimide, phenolic, or the like. An organic polymer or silicon based polymer is used as a pore forming agent to provide passage of the slurry. The pore forming agent may be selected from one of the group consisting of polyester, acrylic, acrylic ester co-polymer, polyamide and polycarbonate.

This mixture of chemicals is cast into a mold at step 84, more specifically, the mixture of chemicals is cast into an internal mold 95 as shown in FIG. 9 to make the soft pad 20 in FIG. 5 or the hard pad 10 in FIGS. 5 and 6. At this time, an adhesive may not be needed depending on the mixture materials of the pad, but, if necessary, a suitable conventional adhesive should be applied to the internal wall of the internal mold 95 prior to casting the mixture in the mold.

The first pad mixture is then cured in the internal mold 95 at about 200° F. for about 5 hours in step 85 to create the inner ingot. After completion of step 85, the internal mold 95 is removed. Then, a second pad mixture made in accordance with steps 80 through 83 is injected in the external mold 96 shown in FIG. 9, which surrounds the previously cured inner ingot. The second pad mixture is then cured in the external mold 96 at about 200° F. for about 5 hours (same as step 85 before). As a result, the second pad mixture is cured and, at the same time, integrated with the previously cured inner ingot. At this time, if pad ingot is cured for forming the lower pad 60 shown in FIG. 5, the first and second pad mixtures respectively are materials to form the lower central soft pad region 20, and lower peripheral soft pad region 30.

After this multi-characterized pad ingot is completely formed, the following conventional steps are carried out to fabricate the CMP pad with a predetermined size and thickness. In step 86, the ingot is cut or sliced into segments having a predetermined thickness, perforated in step 87, grooved in step 88, and pure sulfuric acid (PSA) is applied in step 89 to clean the pad. In step 90, the base pad is laminated thereon, and in step 91, the CMP pad is packaged.

In accordance with the aforementioned method for fabricating the CMP pad, a chemical mixture of multi-characterized ingot is made and cut into segments having a predetermined thickness. Accordingly, the CMP pads shown in FIGS. 5 and 6 are made by adequately attaching the segments of the multi-characterized pads to correspond to the purpose for which they will be used.

When a polishing process is performed using the CMP pads fabricated by the aforementioned method, the surface of the pad will be detected with a sensor. The detection signal will be transmitted to a controller so as to be monitored in a three-dimensional profile. Accordingly, conditioning processes will be periodically performed and a time to replace the CMP pad will be determined by measurement of the degree of thickness reduced by conditionings.

While the invention has been described in detail in terms of specific embodiments, those skilled in the art will recognize that the invention can be practiced with various modifications or changes within the spirit and scope of the appended claims. For example, the present invention is not restricted to a rotary polishing method. If a linear polishing method is performed, the rotary pad structure described herein can be changed to a multi-characterized belt type polishing pad.

As described above, there are advantages in the CMP pad structure and the method for fabricating the same in that polishing uniformity is improved, thereby preventing/minimizing dishing or recesses, as well as preventing/minimizing excessive damage to device patterns at the edge of a wafer. Thus, the prior drawbacks and problems associated with conventional CMP processes are minimized to improve uniformity of layers at the wafer or chip level for highly integrated semiconductor devices, thereby increasing the product yields.

What is claimed is:

1. A multi characterized CMP (Chemical Mechanical Polishing) pad structure, comprising:

a lower pad comprising a lower central soft pad region and a lower peripheral soft pad region formed outwardly of the lower central soft pad region, both the lower central soft pad region and the lower peripheral soft pad region being located in a same plane of the lower pad; and an upper pad disposed on the lower pad, the upper pad comprising an upper central hard pad region and an upper peripheral soft pad region formed outwardly of the upper central hard pad region, both the upper central hard pad region and the upper peripheral soft pad region being located in the same plane of the upper pad, wherein the lower peripheral soft pad region has a lower hardness factor relative to the lower central soft pad region, and the upper peripheral soft pad region has substantially the same hardness factor as the lower central soft pad region.

2. The CMP pad structure of claim 1, wherein the lower central soft pad region has a first diameter, and the lower peripheral soft pad region is a ring shaped region formed radially outward of the lower central soft pad region, the lower peripheral soft pad region having an outer diameter greater then the first diameter, and an inner diameter equal to the first diameter.

3. The CMP pad structure of claim 2, wherein the upper central hard pad region has a diameter equal to the first diameter, with the upper central hard pad region lying on and being coextensive with the lower central soft pad region, and the upper peripheral soft pad region is a ring shaped region formed radially outward of the upper central hard pad region, the upper peripheral soft pad region having an outer diameter greater then the first diameter, and an inner diameter equal to the first diameter.

4. The CMP pad structure of claim 3, further comprising an attaching part formed on a lower surface of the lower pad, for attaching the CMP pad to a table of a CMP apparatus.

5. The CMP pad structure of claim 4, further comprising an attaching layer interposed between the upper pad and the lower pad.

6. The CMP pad structure of claim 5, further comprising an adhesive formed at an interface between the lower central soft pad region and the lower peripheral soft pad region.

7. The CMP pad structure of claim 6, further comprising an adhesive formed at an interface between the upper central hard pad region and the upper peripheral soft pad region.

8. A multi characterized CMP (Chemical Mechanical Polishing) pad structure, comprising:

a lower pad comprising a lower homogeneous soft pad region; and an upper pad disposed on the lower pad, the upper pad comprising an upper central hard pad region and an upper peripheral soft pad region formed outwardly of the upper central hard pad region, both the upper central hard pad region and the upper peripheral soft pad region being located in the same plane of the upper pad, wherein the upper peripheral soft pad region has substantially the same hardness factor as the lower homogeneous soft pad region.

9. The CMP pad structure of claim 8, wherein the upper central hard pad region has a first diameter, and the upper peripheral soft pad region is a ring shaped region formed radially outward of the upper central hard pad region, the upper peripheral soft pad region having an outer diameter greater then the first diameter, and an inner diameter equal to the first diameter.

10. The CMP pad structure of claim 9, wherein the lower homogeneous soft pad region has a diameter substantially equal to the outer diameter of the upper peripheral soft pad region.

11. The CMP pad structure of claim 10, further comprising an attaching part formed on a lower surface of the lower pad, for attaching the CMP pad to a table of a CMP apparatus.

12. The CMP pad structure of claim 11, further comprising an attaching layer interposed between the upper pad and the lower pad.

13. The CMP pad structure of claim 12, further comprising an adhesive formed at an interface between the upper central hard pad region and the upper peripheral soft pad region.

14. A method for fabricating a multi characterized CMP (Chemical Mechanical Polishing) pad, comprising:

preparing a first pad mixture having a first hardness;

injecting the first pad mixture into a first mold;

curing said first pad mixture within the first mold to create a first cured ingot;

removing the first cured ingot from the first mold;

preparing a second pad mixture having a second hardness;

injecting the second pad mixture into a second mold, the second mold being peripherally formed around the first cured ingot, wherein the second mold having an inner diameter equal to a diameter of the first cured ingot, and an outer diameter greater than the diameter of the first cured ingot; and integrally curing the second pad mixture to the first cured ingot to create a multi characterized ingot of a predetermined diameter.

15. The method of claim 14, further comprising cutting the multi characterized ingot into a predetermined thickness.

16. The method of claim 14, wherein the first pad mixture has a higher degree of hardness relative to the second pad mixture.

17. The method of claim 14, wherein the first pad mixture has a lesser degree of hardness relative to the second pad mixture.

* * * * *